US007631776B2

(12) United States Patent
Vovan et al.

(10) Patent No.: US 7,631,776 B2
(45) Date of Patent: Dec. 15, 2009

(54) TAMPER EVIDENT CONTAINER WITH TEAR-APART PARTS

(75) Inventors: Terry Vovan, Upland, CA (US); Jose Enriquez, South Gate, CA (US)

(73) Assignee: PWP Industries, Vernon, CA (US)

( * ) Notice: Subject to any disclaimer, the term of this patent is extended or adjusted under 35 U.S.C. 154(b) by 540 days.

(21) Appl. No.: 11/446,622

(22) Filed: Jun. 5, 2006

(65) Prior Publication Data

US 2006/0278652 A1 Dec. 14, 2006

Related U.S. Application Data

(60) Provisional application No. 60/689,394, filed on Jun. 10, 2005.

(51) Int. Cl.
*B65D 41/32* (2006.01)

(52) U.S. Cl. ..... 220/266; 220/276

(58) Field of Classification Search ..... 220/4.21, 220/4.24, 260, 266, 270, 276, 793; 215/901
See application file for complete search history.

(56) References Cited

U.S. PATENT DOCUMENTS 3,572,579 A * 3/1971 Mueller et al. ..... 229/123.2
3,773,207 A * 11/1973 Dokoupil et al. ..... 220/270
4,332,332 A * 6/1982 Ingemann ..... 220/276
4,881,656 A 11/1989 Chumley et al.
5,052,574 A 10/1991 McKinnon et al.
5,129,531 A 7/1992 Beck et al.
5,170,905 A 12/1992 Luch
5,249,694 A 10/1993 Nelson
5,307,948 A 5/1994 Blackburn et al.
5,377,860 A * 1/1995 Littlejohn et al. ..... 220/790
5,511,679 A 4/1996 Beck
6,604,645 B1 8/2003 Vaupotic
7,011,228 B2 * 3/2006 Ordiway ..... 220/287
7,357,272 B2 * 4/2008 Maxwell ..... 220/785
2006/0060578 A1 * 3/2006 Church et al. ..... 220/4.21
2006/0261070 A1 11/2006 Robertson et al.

* cited by examiner

*Primary Examiner*—Harry A Grosso
(74) *Attorney, Agent, or Firm*—Leon D. Rosen

(57) ABSTRACT

A container clearly indicates that it has been opened after a store clerk loads food into the base of the container and closes a covering of the container onto the base. The covering (16) includes a peripheral cover portion (22) that becomes fixed to a peripheral base portion (32) when the clerk initially closes the container. To thereafter open the container, a person forcefully lifts a tab (30) on the covering to tear the covering along a long tear line (26) that separates the peripheral cover portion (22) from a lid (24) formed by a radially inner covering portion. The base (12) is fixed to the peripheral covering portion (22), and together they form a base device (40). After the lid has been torn free of the peripheral covering portion, the lid can be closed and latched to the base device and then can be easily opened again. The container is supplied to the store with an adhesive strip (34) that the clerk activates by shining ultraviolet light (UV) at the adhesive after he/she places the loaded and initially closed container in a UV chamber (86), or mechanical latches with tabs engaging shoulders can be used.

5 Claims, 4 Drawing Sheets

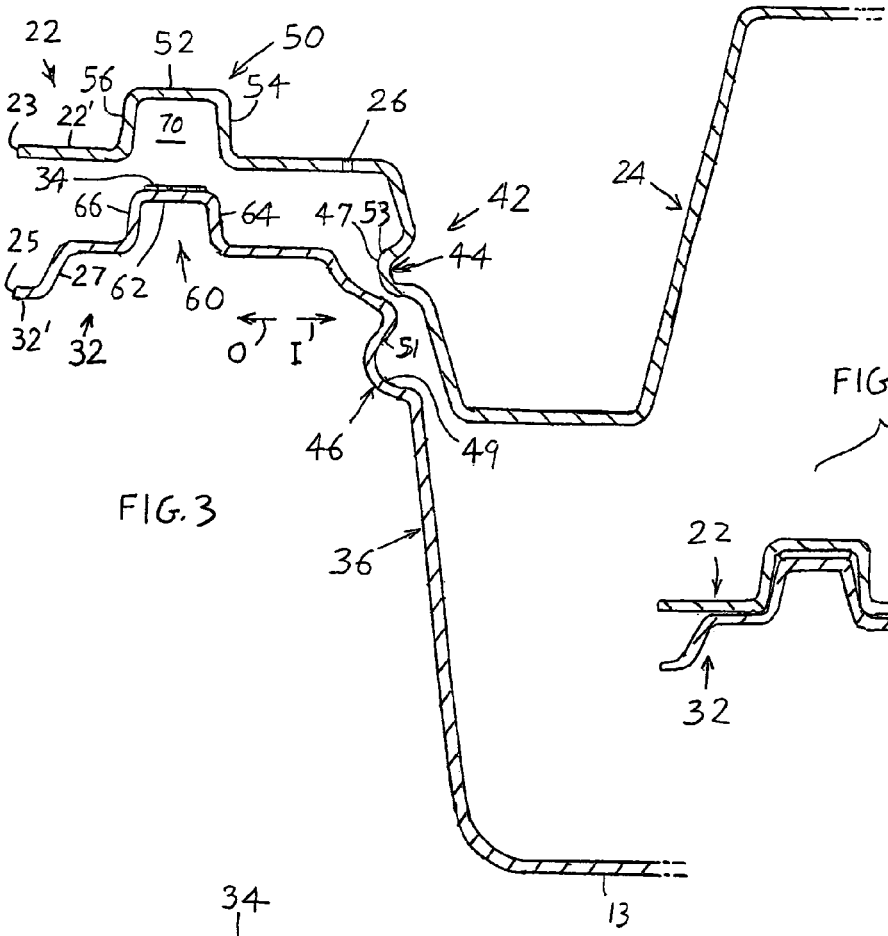
FIG. 3
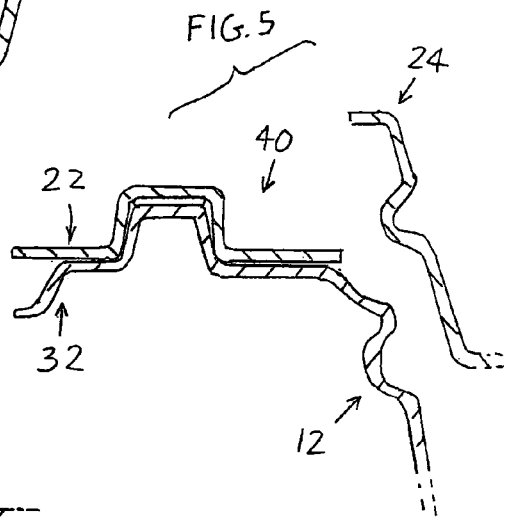
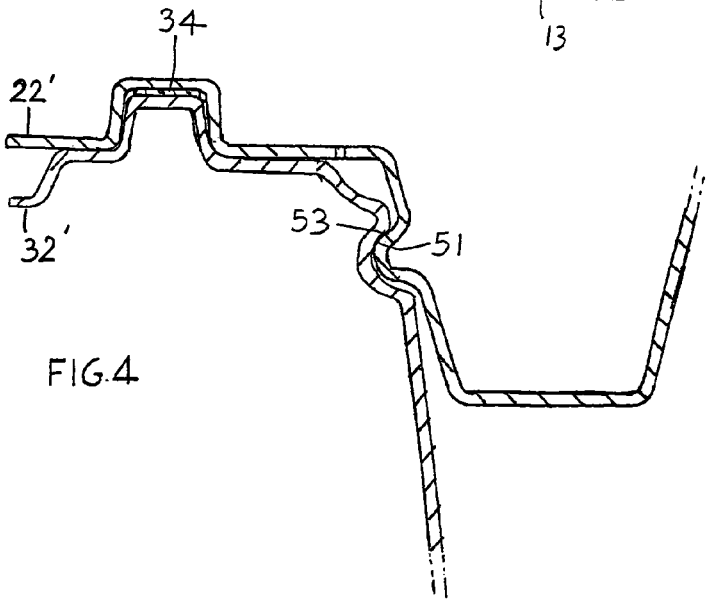
FIG. 4

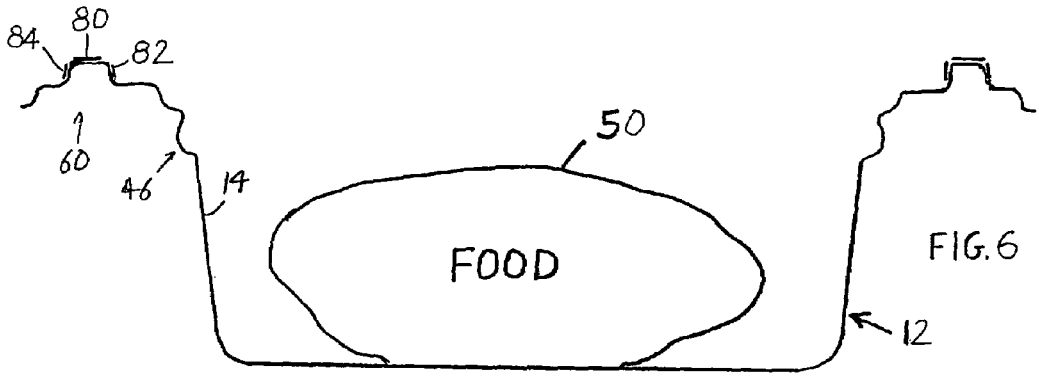
FIG. 6
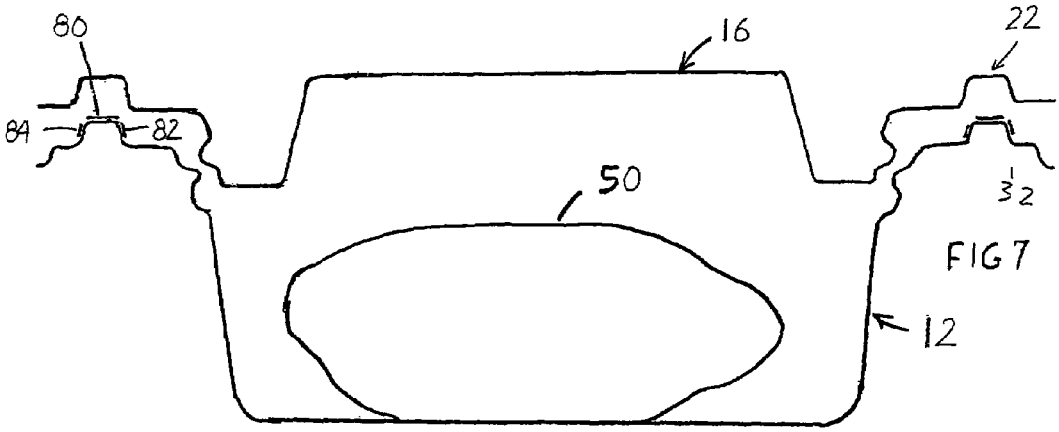
FIG 7
FIG. 8
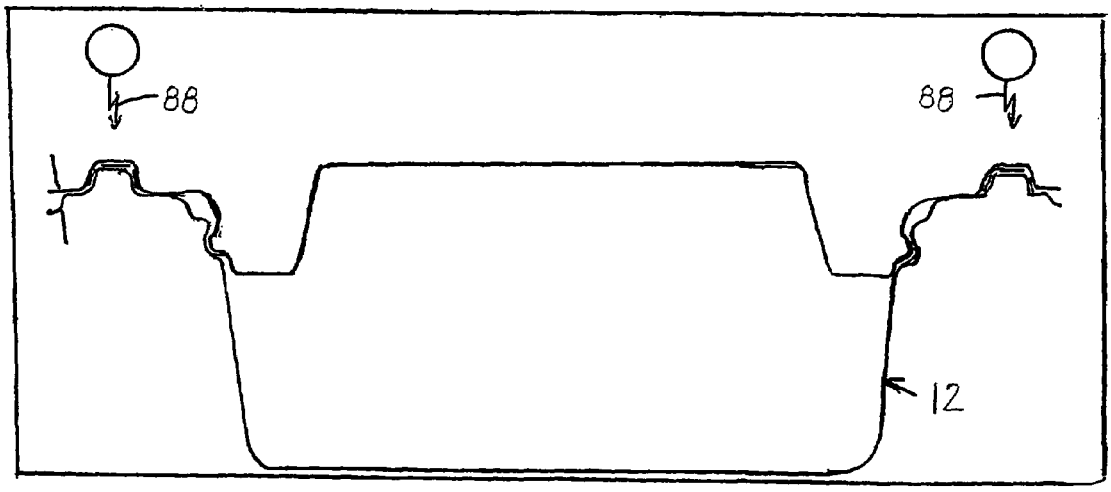

TAMPER EVIDENT CONTAINER WITH TEAR-APART PARTS

CROSS REFERENCE

Applicant claims priority from U.S. Provisional Patent Application Ser. No. 60/689,394 filed Jun. 10, 2005.

BACKGROUND OF THE INVENTION

Food is often placed in a transparent container that includes a base with an upwardly-opening cavity that holds food and with a lid that closes the cavity. Buyers want to be assured that, after the food was placed in the container as by a clerk at the food store (who often wears plastic gloves to avoid food contamination), that the container has not been opened. There is a possibility that another customer has secretly opened the container enough to taste a bit of the food before closing it (and possibly leaving germs from his/her finger in the food). Potential buyers want to be assured that this has not happened. A container constructed by the container manufacturer that allowed a clerk at a store to easily close the container and lock it closed, and that thereafter clearly indicated to a potential customer whether or not the container has been opened since it was first closed by the clerk, would be of value. The clear indication of tampering is especially useful for containers that hold food, but is also useful for containers that hold many small nonfood items to assure a customer that some of the original items have not been taken.

SUMMARY OF THE INVENTION

In accordance with one embodiment of the invention, a container is provided of the type that includes a base and covering formed of plastic sheeting, which allows the container to be initially closed as by a store clerk, and which thereafter prevents the container from being casually and secretly opened. The container can be initially opened only by applying a large sustained pull force to separate a lid of the covering from a peripheral cover portion that is fixed to a peripheral base portion of the base. After being initially opened, the lid can be easily replaced on the base (which is now a base device that includes the peripheral cover portion) and the lid latches itself closed on the base and can be easily opened.

The container is supplied by the manufacturer so when the covering is initially closed on the base, as by a store clerk pushing the covering onto the base and activating an adhesive, the peripheral cover portion becomes fixed to a peripheral portion of the base. The covering includes a tear line, such as a line of perforations, that separates the peripheral cover portion from the lid. After such initial closing of the container, initial opening of the container requires that the lid be lifted to tear it free of the peripheral cover portion. The fact that the lid has been torn free of the peripheral cover portion, is obvious when looking at the container, so a potential buyer of the food-holding container is assured that food in the container has not been touched by another customer.

The novel features of the invention are set forth with particularity in the appended claims. The invention will be best understood from the following description when read in conjunction with the accompanying drawings.

DESCRIPTION OF THE DRAWINGS

FIG. 3 is a sectional view of a portion of a container taken on line 3-3 of FIG. 1, but with the base and covering separated prior to initial closing of the container.

FIG. 4 is a view of the container similar to the view of FIG. 3, but with the base and covering after they have been initially closed and before they have been initially opened.

FIG. 5 is a view of the container similar to the view of FIG. 4, after the container has been initially opened following its initial closing, showing that the lid of the covering has been separated from a base device formed by the base and peripheral cover portion.

FIG. 6 is a sectional side view of the container of FIG. 1, after food has been loaded into the base, but before the covering has been closed on the base, and with two additional strips of adhesive.

FIG. 7 is a view similar to that of FIG. 6, showing the covering as it approaches the base during the initial closing of the container.

FIG. 8 is a view similar to that of FIG. 7, but with the covering lying in the closed position on the base, and during the application of ultraviolet light to activate a quantity of adhesive that fixes the covering to the base.

DESCRIPTION OF THE PREFERRED EMBODIMENTS

Figure 1:
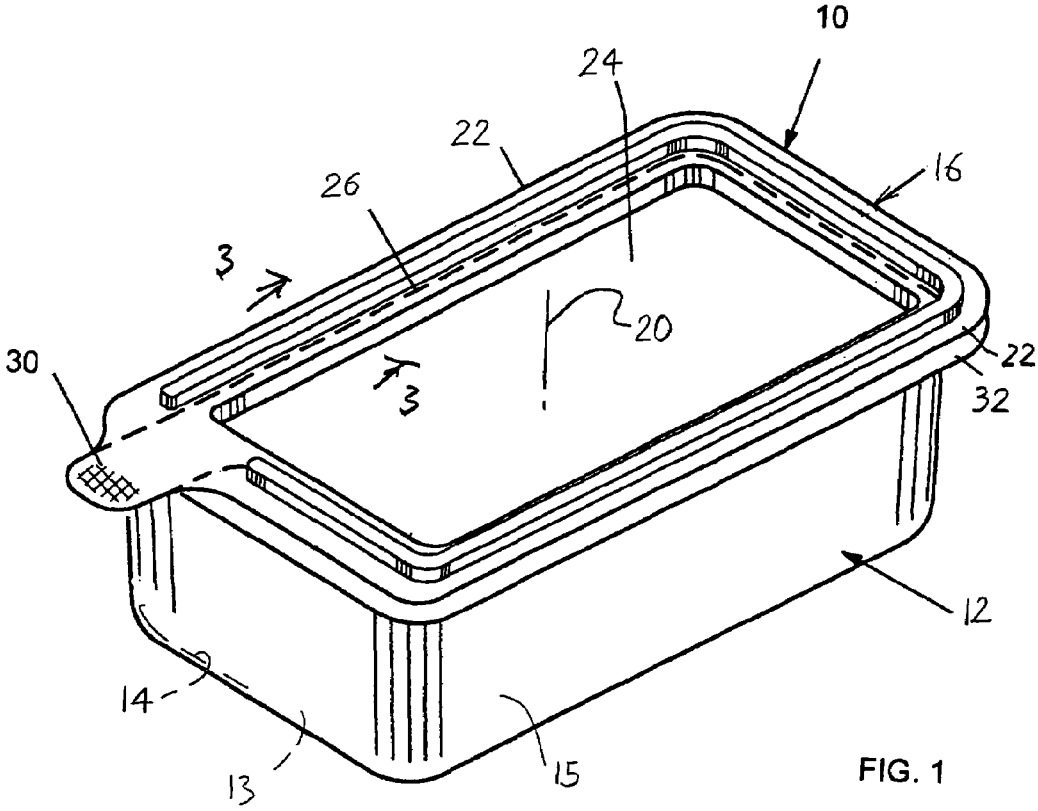
FIG. 1 is a top isometric view of a container of the present invention.

FIG. 1 shows a container 10 which includes a basically rectangular base 12 with a bottom 13 four sides 15, that forms an upwardly opening cavity 14, and a covering 16 that covers the base. Both the base and covering are formed of plastic sheeting, such as by two sheets of transparent plastic that have been vacuum formed, each of 0.020 inch thickness. The container has a vertical axis 20. The covering includes a peripheral cover portion 22 that is fixed to the base, and also includes an inner cover portion or lid 24 with a majority of the lid lying radially inward (with respect to axis 20) of the peripheral cover portion. A tear line 26 lies between the peripheral cover portion 22 and the lid 24. A lift tab 30 can be pulled up forcefully (e.g. with a force of 10 pounds) while the peripheral base portion 22 is held down, to tear the tear line and thereby separate the lid from the peripheral cover portion. FIGS. 1 and 3 also shows skirts, or primarily horizontal flanges 22', 32', with free outer edges 23, 25, on the base and cover portions, the base flange 22' projecting a shorter distance than 32', from the bottom of a downward skirt 27. FIG. 4 shows that the gap between the flanges 22', 32' is a plurality of times the thickness of the sheet plastic.

FIG. 3 shows the tear line 26 that separates the peripheral cover portion 22 from the lid 24. The base has a peripheral base portion 32 to which the peripheral cover portion 22 can be fixed, by a quantity of adhesive 34. The base also has a radially inner base portion 36. After the peripheral cover portion 22 has been fixed to the peripheral base portion 32, and the lid has been torn free along the tear line 26, the lid 24 is free as shown in FIG. 5. The peripheral cover portion 22 remains on the base as shown in FIG. 5. Together, the base 12 and the peripheral cover portion 22 form a base device 40. The lid can be repeatedly closed on the base device and easily lifted off of it.

As shown in FIG. 3, the container has a latch 42 that includes a lid latch part 44 that can readily latch to a base latch part 46. The lid latch part has a radially outwardly (O) extending projection 47, (i.e. generally away from the container axis), while the base latch part has a radially-inward (I) opening recess 49. The latch in its closed position in FIG. 4, prevents unlatching unless inclined shoulders 51, 53 on the base and lid are deflected horizontally. The inclined shoulders allow the lid to be pulled free of the base by applying a moderate upward force such as 3 pounds to the lift tab.

FIG. 3 shows that the peripheral cover portion 22 includes a covering hat part 50 that includes a flat primarily horizontal hat middle wall 52 and radially inner and outer hat side walls 54, 56 that are flat and extend primarily vertically. The peripheral base portion 32 a has a base hat part 60 that includes a flat primarily horizontal middle wall 62 and flat opposite side walls 64, 66. When the covering is pressed down against the base, one of the hat parts fits into the other hat part. In FIGS. 1-8, the covering hat part 50 has a downwardly-opening recess 70 that receives the upwardly-projecting base hat part. When the hat parts fit into one another, their side wall lie facewise adjacent to each other. A quantity of adhesive on any of the walls then can bond the walls together. In FIG. 3 the quantity of adhesive 34 in the form of a self-contained strip has been placed on the hat middle wall 62 of the base. The side walls of the hat parts resist relative horizontal movement of the peripheral portions even without adhesive. The covering has a covering transition portion 72 that extends primarily horizontally and that separates the covering hat part 50 from the tear line 26. the transition portion 72 has a horizontal length at least as great as that of the hat middle walls (52, 62).

FIGS. 6 though 8 show three steps in the handling of the container by a store clerk. Initially, many bases 12 are shipped in a stack and many coverings 16 are shipped in a separate stack. In FIG. 6, all three sides of the base hat part 60 are covered with adhesive. FIG. 6 shows three strips of activatable adhesive such as 80, 82 and 84 which lie on each of the three sides of the base hat 60. The adhesive is not activated, so its will not yet bond the base hat to the covering hat. A clerk in a food store who is normally wearing plastic gloves, takes a base from its stack and loads goods such as food 50 (FIG. 6) into the base cavity. As shown in FIG. 7, the clerk then pushes down the covering 16 onto the base. The clerk makes sure that the peripheral cover portion 22 is well seated on the base. As shown in FIG. 8, the clerk then places the container with food therein, in a UV (ultraviolet light) chamber 86. In the chamber, ultraviolet light 88 is directed onto the adhesive to activate it so the adhesive strongly bonds the peripheral portions of the covering and of the base. The container is now ready for display for sale, and customers can see that the container has not been opened because the tear line has not been ripped.

Figure 2:
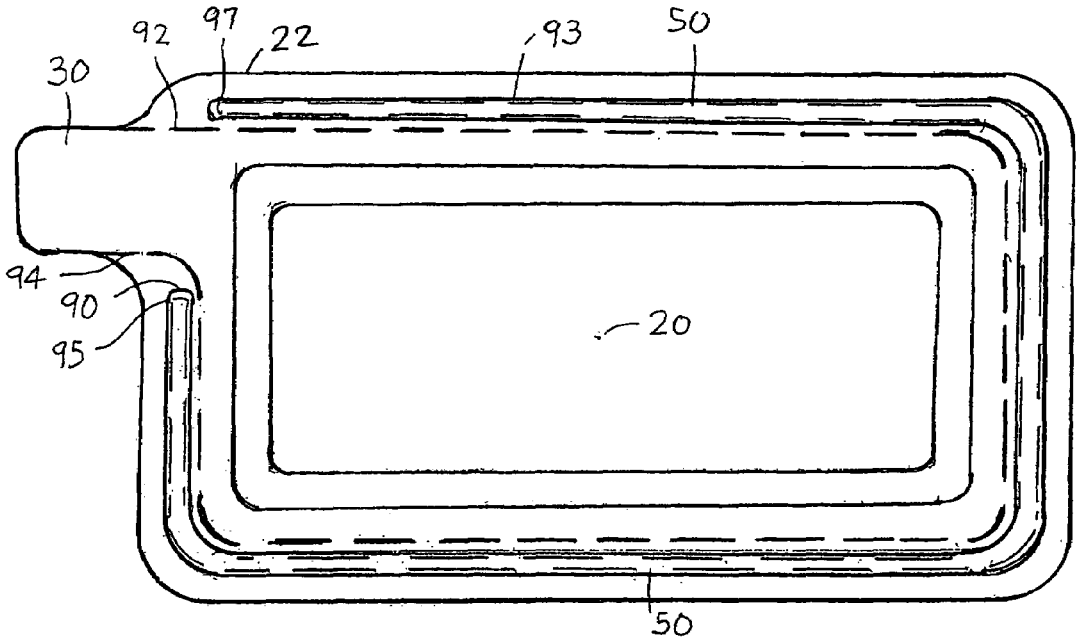
FIG. 2 is a plan view of the container of FIG. 1.

FIG. 3 shows adhesive 34 which has been applied to only the base hat middle wall 62, although adhesive could be applied to the base hat side walls as in FIGS. 6-8. FIG. 2 shows that the tear line 26 extends on either side of the lift tab 30 to the extreme edge of the covering. The lift tab extends horizontally at least one-quarter inch radially beyond the covering so it can be easily grasped. The peripheral cover portion ends at opposite tear line ends 92, 94 which lie in a gap 90. FIG. 2 also shows that the hat parts such as the covering hat part 50, extend around the entire container periphery except for the gap 90 around the lift tab 30. The adhesive is preferably applied along the entire container periphery except for the gap 90. The adhesive is preferably in the form of a strip 93 that extends along the entire lengths of the hat parts, although there can be gaps in such strip of adhesive. The adhesive strip should lie at 95 and 97 on opposite sides of the tear gap 90. It is possible to provide one or more strips of contact adhesive with inner faces that are bonded to one of the hat parts at the container manufacturing factory, and with outer faces that are protected with peel-off strips. In that case, the adhesive is activated (made ready to stick to a surface it contacts) by the clerk peeling off the peel-off strip. However, the strongest bonding is usually obtained by an adhesive that is activated by shining ultraviolet light at the adhesive. The adhesive is preferably applied to the one of the two hat parts with exposed surfaces (that do not lie in a recess) to be bonded to.

Figure 9:
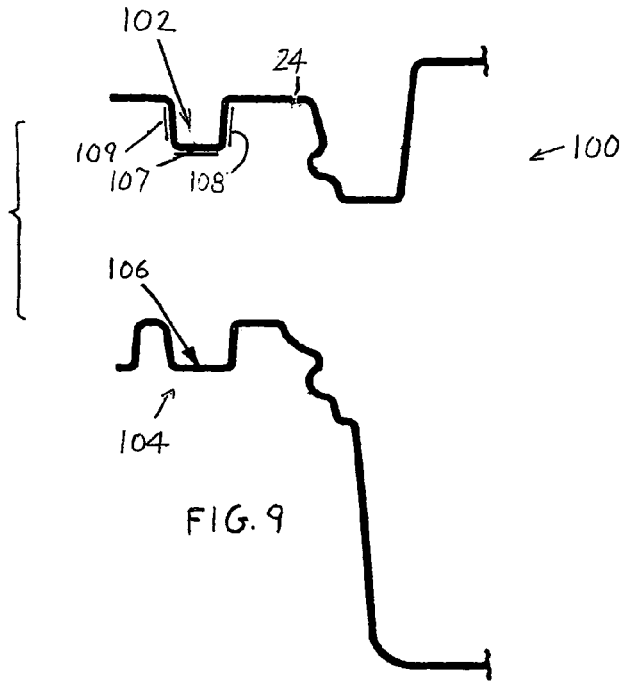
FIG. 9 is an exploded view of a portion of a covering and of a base, which is similar to that of FIG. 3, but with the hat parts of the cover and base peripheral portions upside-down from the positions of FIG. 3.

FIG. 9 shows another container 100 which is modified from the container of FIG. 3 by the covering hat part 102 projecting downward so all of its lower surfaces are exposed. The base hat part 104 forms an upwardly-opening recess 106 that receives the covering hat part and adhesive strips 107, 108, 109 on the covering hat part.

Figure 10:
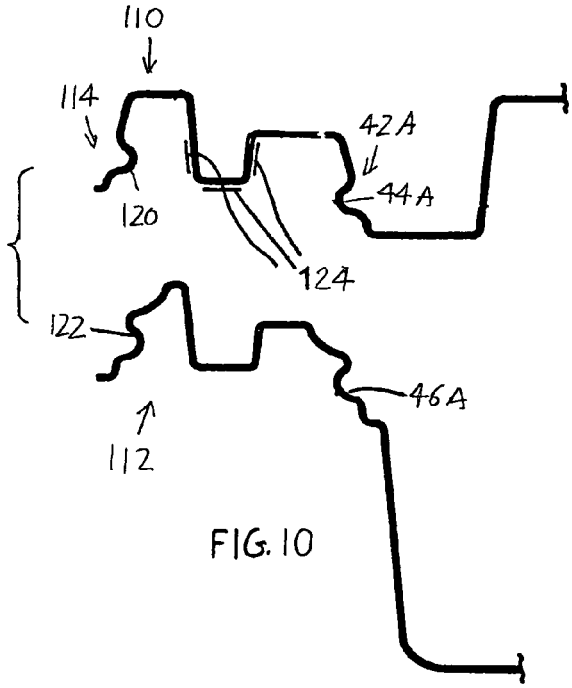
FIG. 10 is an exploded view of a portion of a covering and of a base, which is similar to that of FIG. 9, but with additional latch parts for assuring good adhesion of the covering to the base.

FIG. 10 shows another container which is similar to that of FIG. 9, except that the peripheral covering portion 110 and peripheral base portion 110, 112 are formed with a mechanical outer latch device 114 that includes outer latch device parts 120, 122. This is in addition to the lid latch 42A which has a covering part 44A and a base latch part 46A. The outer latch device 114 (in addition to latch 42A) holds the peripheral covering portion closed firmly on the peripheral base portion, so the orientations of the hat part walls and of the adhesive strips is more closely controlled. This helps assure that adhesive strips 124 will bond to both pairs of adjacent walls of the hat parts as well as the horizontal hat wall.

Figure 11:
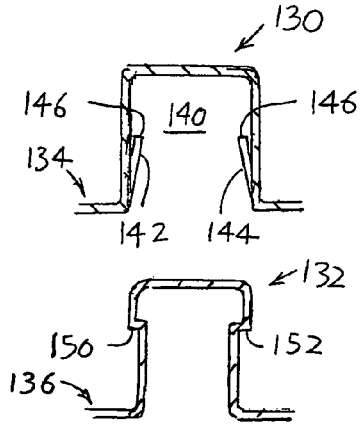
FIGS. 11 and 12 are partial sectional views of a covering and a base of another embodiment of the invention, wherein the covering and base are fixed together only by mechanical parts of each of them.
Figure 12:
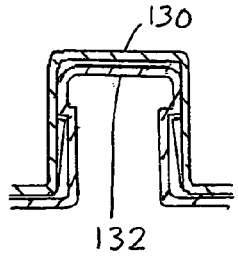

FIG. 11 illustrates another design of hat parts 130, 132 on the peripheral parts 134, 136 of the covering and the base. The covering hat part 130 forms a recess 140 and forms a pair of tabs 142, 144 with free upper ends 146, that project into the recess. The free upper ends form upwardly-facing shoulders. The base hat part 132 forms a pair of downwardly-facing shoulders 150, 152. When the base hat part is inserted into the recess of the covering hat part as in FIG. 12, the downwardly-facing shoulders of the base hat part engage the upwardly-facing shoulders on the tabs, and prevent the peripheral base part 136 from separating from the covering. Applicant prefers to provide many pairs of tabs 142, 144 along the length of the hats around the container, or one very long pair of tabs. Applicant prefers to taper the heights of the tabs and/or shoulders that engage the tabs. This assures that a long length of tab(s) and shoulders are engaged when the lift tab 30 (FIG. 1) is lifted far enough to begin tearing along the tear line. The tabs and shoulders lie at the locations 95, 97 on opposite sides of the tear gap 90.

In one example, the container is constructed of two separate sheets of 0.020 inch thick transparent plastic, and has a container width of 5 inches and a container length of 8 inches except at the lift tab.

Thus, the invention provides a tamper evident container that includes a base and covering with peripheral portions that are readily fixed to one another when a clerk loads food or other goods into the base and closes the covering on the base. In one container, adhesive lies on at least one of the peripheral portions and a clerk easily activates the adhesive as by directing ultraviolet light at it. The covering includes a lid that is joined to the peripheral covering portion by a tear line. When a consumer who has bought the container filled with goods decides to open it, the consumer has to apply a sustained force, such as a force applied along a distance of 7.5 inches for a container of a length of 8 inches, with the container making considerable noise when the tear line is torn. The tear force is large, such as 10 pounds. The lid and base form a latch so that after the container is opened by a customer, it requires the application of a smaller force such as a downward force of 3 pounds applied along a distance such as one-quarter inch, to close the container, and a similar upward force and force-applied distance to reopen the container. The fact that the container makes considerable noise when initially opened after a clerk has initially closed the container, the large initial opening force and force-applied distance, and the fact that the container clearly indicates when it has been opened, makes it unlikely that a customer will secretly open the container and assures customers that the container has not been opened.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A tamper evident container which has a vertical axis, comprising:

a base which forms an upwardly-opening cavity;

a covering which is closed on said base to cover said cavity, said base and said covering being formed of plastic sheeting;

said covering has a peripheral covering portion that is fixed to said base, and said covering has a radially inner covering portion that lies on said axis and that forms a lid that is joined to said peripheral covering portion by a tear line where said covering is weakened and can be torn by manually applying a first lifting force to the lid, so the lid can be removed while the peripheral covering portion remains with the base so the base and peripheral covering portion together form a base device;

said lid being constructed to reclose on said base device, and said lid having a latch part that latches to said base device when said lid is reclosed on said base device, and that unlatches from said base device to allow the lid to be removed by applying a manual lift force to the lid that is less than said first lifting force, so after said tear line is torn and said lid is removed, said lid can be replaced on the base device and thereafter the lid can be easily lifted to unlatch from the base device and then can be latched closed again on the base device;

said base and said peripheral covering portion each forms a mechanical connection hat of a hat cross-section forming a pair of radially-spaced hat sides, and with one of the connection hats of said base and of said peripheral covering portion fitting into the other hat;

one of said connection hats has a pair of shoulders at said opposite hat sides and the other has a pair of tabs at said opposite hat/sides that each has a tab free end that resiliently deflects to engage one of the shoulders when the base and peripheral covering portions are moved together, to thereafter prevent the base and peripheral covering portions from moving apart.

2. A tamper evident container which has a vertical axis, comprising:

a base which forms an upwardly-opening cavity;

a covering which is closed on said base to cover said cavity, said base and said covering being formed of plastic sheeting;

said covering has a peripheral covering portion that is fixed to said base, and said covering has a radially inner covering portion that lies on said axis and that forms a lid that is joined to said peripheral covering portion by a tear line where said covering is weakened and can be torn by manually applying a first lifting force to the lid, so the lid can be removed while the peripheral covering portion remains with the base so the base and peripheral covering portion together form a base device;

said lid being constructed to reclose on said base device, and said lid having a latch part that latches to said base device when said lid is reclosed on said base device, and that unlatches from said base device to allow the lid to be removed by applying a manual lift force to the lid that is less than said first lifting force, so after said tear line is torn and said lid is removed, said lid can be replaced on the base device and thereafter the lid can be easily lifted to unlatch from the base device and then can be latched closed again on the base device;

said base and said peripheral covering portion each forms a mechanical connection hat of a hat cross-section forming a pair of radially-spaced hat sides, and with one of the connection hats of said base and of said peripheral covering portion fitting into the other connection hat;

one of said connection hats has a pair of downwardly-facing first shoulders at said opposite hat sides and the other has a pair of upwardly-facing second shoulders at said opposite hat/sides that each resiliently deflects to engage one of said first shoulders when the base and peripheral covering portions are moved together, to thereafter prevent the base and peripheral covering portions from moving apart.

3. A tamper evident container which has a vertical axis, comprising a base which forms an upwardly-opening cavity, a covering which is closed on said base to cover said cavity, said base and said covering being formed of plastic sheeting, said covering has a peripheral covering portion (22) that is fixed to said base, and said covering has a radially inner covering portion that lies on said axis and that forms a lid (24) that is joined to said peripheral covering portion by a tear line (26) where said covering is weakened and can be torn by manually applying a lifting force to the lid, so the lid can be removed while the peripheral covering portion remains with the base so the base and peripheral covering portion together form a base device, and said lid being constructed to reclose on said base device, wherein:

said base has a base joining part (60) and said covering has a covering joining part (50) that is fixed to said base joining part;

said covering has a covering transition portion (72) that extends from said covering joining part (50) to said tear line (26) with all parts of said transition portion being free of being fixed to said base;

said base and covering joining parts each has a first portion with a hat cross-section (50, 60) that includes a primarily horizontal hat base (52, 62) and a pair of radially-spaced primarily vertical hat sides (54, 56, 64, 66), with one of said joining parts fitting into the other joining part, and with said covering transition portion (72) extending primarily horizontally from one of said hat sides to said tear line.

4. The container device described in claim 3 wherein:

said transition portion (72) is at least as long horizontally as the width of said hat bases (52, 62).

5. A tamper evident container which has a vertical axis, comprising a base which forms an upwardly-opening cavity, a covering which is closed on said base to cover said cavity, said base and said covering being formed of plastic sheeting, said covering has a peripheral covering portion (22) that is fixed to said base, and said covering has a radially inner covering portion that lies on said axis and that forms a lid (24) that is joined to said peripheral covering portion by a tear line (26) where said covering is weakened and can be torn by manually applying a lifting force to the lid, so the lid can be removed while the peripheral covering portion remains with the base so the base and peripheral covering portion together form a base device, and said lid being constructed to reclose on said base device, wherein:

said base and covering portions each has a hat-shaped portion (50, 60) with a hat cross-section that includes a hat middle wall (52, 62) and a pair of radially-spaced hat sides (54, 56, 64, 66), with the hat cross-section of one of said joining parts fitting closely into the hat cross-section of the other joining part so said horizontal hat middle walls lie closely facewise adjacent to each other, said hat-shaped portion of said covering being spaced from said tear line, and including:

a self-contained strip of adhesive material (34) lying between and joining said hat-shaped portions of said base and covering including said radially spaced hat sides of the base and covering.

* * * * *

UNITED STATES PATENT AND TRADEMARK OFFICE

CERTIFICATE OF CORRECTION

PATENT NO. : 7,631,776 B2
APPLICATION NO. : 11/446622
DATED : December 15, 2009
INVENTOR(S) : Terry Vovan et al.

It is certified that error appears in the above-identified patent and that said Letters Patent is hereby corrected as shown below:

Delete Figure 3 and substitute Figure 3 below therefor.

Figure 3 is corrected by adding number 72.

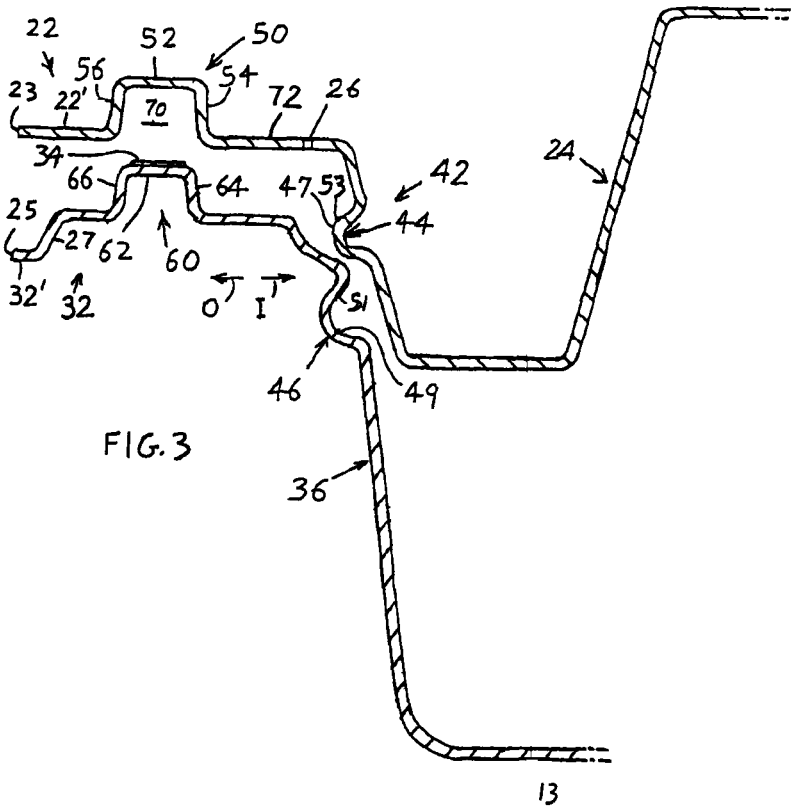

FIG. 3

Signed and Sealed this
First Day of March, 2011

David J. Kappos

David J. Kappos
*Director of the United States Patent and Trademark Office*